US008530735B2

(12) United States Patent
Maebius et al.

(10) Patent No.: US 8,530,735 B2
(45) Date of Patent: Sep. 10, 2013

(54) SYSTEM FOR DISPLAYING AND SCROLLING MUSICAL NOTES

(76) Inventors: Stephen Maebius, Great Falls, VA (US); Maria Maebius, Great Falls, VA (US)

( * ) Notice: Subject to any disclaimer, the term of this patent is extended or adjusted under 35 U.S.C. 154(b) by 208 days.

(21) Appl. No.: 12/961,466

(22) Filed: Dec. 6, 2010

(65) Prior Publication Data

US 2011/0132176 A1 Jun. 9, 2011

Related U.S. Application Data

(60) Provisional application No. 61/267,009, filed on Dec. 4, 2009.

(51) Int. Cl.
*G10H 7/00* (2006.01)

(52) U.S. Cl.
USPC ..... 84/612

(58) Field of Classification Search
USPC ..... 84/612
See application file for complete search history.

(56) References Cited

U.S. PATENT DOCUMENTS 5,760,323 A 6/1998 Romero et al.
6,166,314 A * 12/2000 Weinstock et al. ..... 84/483.1
6,518,492 B2 2/2003 Herberger et al.
6,545,208 B2 * 4/2003 Hiratsuka ..... 84/476
6,546,229 B1 * 4/2003 Love et al. ..... 434/308
6,838,608 B2 * 1/2005 Koike ..... 84/477 R
7,297,856 B2 * 11/2007 Sitrick ..... 84/477 R
7,482,529 B1 1/2009 Flamini et al.
7,919,705 B2 * 4/2011 Miller ..... 84/616
8,053,657 B2 * 11/2011 Sitrick et al. ..... 84/477 R
2001/0037719 A1 * 11/2001 Gardner et al. ..... 84/478
2002/0005109 A1 * 1/2002 Miller ..... 84/609
2005/0016361 A1 * 1/2005 Ikeya et al. ..... 84/602
2009/0183623 A1 * 7/2009 Mueller ..... 84/612
2009/0255396 A1 * 10/2009 Flamini et al. ..... 84/477 R
2011/0203442 A1 * 8/2011 Raveendran ..... 84/483.1
2011/0277615 A1 * 11/2011 Kendler et al. ..... 84/483.2

OTHER PUBLICATIONS www.idolmusicstar.com/en/index.php. 2 pages. Printed Feb. 4, 2013.
www.sharewareconnection.com/beat-monitor.htm. 3 pages. Printed Feb. 4, 2013.
www.supershareware.com/info/midimaster-karaoke.html. 3 pages. Printed Feb. 4, 2013.
pda.wareseeker.com/Multimedia/tap-that-1.0.2.zip/150596f669. 3 pages. Printed Feb. 4, 2013.

* cited by examiner

*Primary Examiner* — Jeffrey Donels

(57) ABSTRACT

The present invention relates to a system for displaying and scrolling musical notes and a method for a user to perform music using such a system. In particular, the system includes a tempo detector for detecting the user's tempo, so that musical notes are displayed and scrolled in synchronization with the user's actual tempo. A group of tablet-shaped display devices incorporating such a system can be used to display musical notes for multiple instruments, which may be the same or different instruments, to a group of users.

31 Claims, 3 Drawing Sheets

SYSTEM FOR DISPLAYING AND SCROLLING MUSICAL NOTES

PRIORITY

This application claims the benefit of U.S. Provisional Application No. 61/267,009, which is here incorporated by reference in its entirety.

BACKGROUND

Various attempts have been made to address the problem of how to scroll or advance virtual sheet music for a user playing an instrument or singing a song, who is watching the musical notes from a score on a display screen. The need for a system that advances or scrolls the musical notes in a synchronized manner that corresponds to the real-time tempo of the user who is actually playing or singing the music is even more important with the advent of personal digital assistants, portable reader devices, and cell phones containing smaller displays that are highly portable.

U.S. Pat. No. 7,482,529 describes a self-adjusting music scrolling method, which comprises providing a display screen, selecting a music score to be played by a musician, wherein the music score is cataloged and stored in a music score database as a first MIDI file, displaying a first portion of the selected music score on the display screen, recording musical notes played by a musician with a digital device, storing the recorded musical notes in memory as a WAV file, converting the WAV file into a second MIDI file, comparing the first MIDI file and the second MIDI file with a MIDI comparison algorithm, determining if the first MIDI file substantially matches the second MIDI file, automatically adjusting the music score on the display screen to show a second portion of the selected music score upon determining that the first MIDI file substantially matches the second MIDI file, and displaying one or more mistakes detected on the display screen upon determining that the first MIDI file does not substantially match the second MIDI file.

U.S. Pat. No. 5,760,323 describes an electronic display stand that can advance through musical notes without interrupting a musician's performance. The stand can be controlled by remote mechanical actuation, the sound of musical notes (note detection), or a timed interval. The device can have a display large enough to display a full page of sheet music at one time. A plurality of the devices can be networked to simultaneously display musical notes to a number of musicians.

Software exists for karaoke systems that displays lyrics of a song where each word is highlighted in time to the melody so a singer can devote the correct amount of time for each word. For example, see MIDI Master Karaoke 3.5 described at http://www.supershareware.com/info/midimaster-karaoke.html.

In addition, software exists in connection with Karaoke systems for analyzing pitch of a singer's performance, in which a melody guide is graphically displayed, matching what the user must sing. With a microphone, the software analyze the user's singing and computes a score. For example, see http://www.idolmusicstar.com/en/index.php.

Also, software exists for detecting beats per minute from a musical sample. For example, see Beat Monitor at http://www.sharewareconnection.com/beat-monitor.htm. Another example is U.S. Pat. No. 6,518,492, which describes software for detecting beats per minute from a digitized or live musical sample.

SUMMARY

In one embodiment, the present invention is directed to a method of displaying music on a display screen associated with a device that includes a memory and a processor, the method, performed by the device, comprising: selecting a song from the memory, displaying a first portion of musical notes from said song on the display screen, where the first portion is less than an entirety of the musical notes, detecting a tempo of a user's performance of the song on a musical device, calculating a time period for the user to complete, on the musical device, performance of said first displayed portion of musical notes, and automatically replacing, at an end of the time period, said first portion of musical notes on the display screen with a subsequent portion of musical notes from said song.

In another embodiment, the method may comprise presenting a visual cue on the display screen that shows the user when each individual musical note within the first portion of musical notes should be completed according to the tempo of the user's performance. The visual cue may be a temporary change in a visual appearance of the musical note, on the display screen, that lasts for a period of time corresponding to a length of the musical note.

The portion of musical notes may be displayed in multiple ways, including as a single horizontal line or as at least two horizontal lines of musical notes from the song. This may include full pages of music from the song. In addition, lyrics associated with the song being displayed may optionally be displayed. In another embodiment, multiple horizontal lines corresponding to different instruments may be displayed.

The detection of tempo may be conducted in multiple ways. For example, it may include receiving, via a microphone associated with the device, sounds from the user's performance, and measuring the tempo as beats per minute from the sounds received by the microphone, and wherein calculating the time period includes calculating a time period for the user to complete the first portion of musical notes by dividing a total number of beats in the first portion of musical notes by the user's beats per minute rate. In another manner, detecting the tempo may include detecting the tempo only once at a beginning of the song and using the tempo for calculating time periods for displaying subsequent portions of musical notes. Another embodiment includes detecting one or more tempos for different portions of the song. In another implementation, a first tempo and a second tempo are detected for a first subset of the song and a second subset of the song, respectively, wherein the time period is calculated for the user to complete, on the musical device, performance of said first subset of the song and said second subset of the song, and wherein at an end of the time period for the first subset of the song, the display screen is automatically replaced with said second subset of the song, displayed at a rate corresponding to an end of the time period for the second subset of the song. Another implementation includes, optionally, detecting one or more additional tempos for one or more additional subsets of the song, which are displayed according to its calculated time period.

In another embodiment, the method may comprise presenting, to the user, an option to order an additional song, receiving selection of the option, contacting a server device to obtain the additional song, and storing the additional song in the memory.

Another embodiment includes where the device is one of a plurality of devices, and where displaying the first portion of musical notes includes displaying a first version, of the first portion of musical notes, on the display screen associated with the device, and concurrently displaying a second version, of the first portion of musical notes, on a display screen associated with another one of the plurality of devices, where the first version and the second version differ and correspond to a group of musical instruments. The plurality of connected devices may display the same or different versions of the song as the other devices.

The automatic replacement of musical notes may be displayed in different ways. For example, in one embodiment, automatically replacing said first portion of musical notes includes continuously scrolling the at least two horizontal lines of musical notes, on the display screen, upward at a rate controlled by the calculated time period. In another embodiment, the automatically replacing said first portion of musical notes includes concurrently removing an entirety of the at least two horizontal lines of musical notes from the display screen and presenting subsequent set of lines of musical notes from the song. In yet another embodiment, automatically replacing said first portion of musical notes includes concurrently removing a subset of the at least first portion of musical notes from the display screen and presenting subsequent lines of musical notes from the song.

Another embodiment of the present invention is a device for displaying and scrolling music according to a user's tempo, comprising a memory having stored therein at least one song comprising a plurality of musical notes, a display for displaying at least one portion of musical notes, a detector for detecting a user's tempo, and a processor for calculating a time period for displaying each portion of musical notes for a time sufficient for the user to complete that portion of musical notes based on the user's tempo.

In one embodiment, a device includes a memory to store a plurality of songs, an input device to receive selection of one of the plurality of songs, a display screen, and a processor to: present a first portion of musical notes from said song on a display screen associated with the device, where the first portion is less than an entirety of the musical notes, detect a tempo of a user's performance of the song on a musical device, calculate a time period for the user to complete, on the musical device, performance of said first displayed portion of musical notes, and automatically replace, at an end of the time period, said first portion of musical notes on the display screen with a subsequent portion of musical notes from said song. In another embodiment, the display screen, input device, memory, and memory are housed in a single device. The single device may be a tablet device, a personal digital assistant, or other device adapted to fit a music stand. Optionally, the device is one of a plurality of connected devices. In another implementation, one device of a plurality of connected devices is a master with the tempo detector that wirelessly controls the displayed portion of musical notes for each different instrument on each of the other tablet devices. In another possible implementation, the other devices controlled by the master in the plurality of connected devices do not have tempo detectors. Optionally, the plurality of connected devices are tablet devices. Alternatively, the device includes a micro-projector, and where displaying the first portion of musical notes includes projecting the first portion of musical notes onto a surface for viewing by the user. In one embodiment, the tempo detector comprises a pressure sensor that determines a user's tempo when the user taps the sensor two or more times at a rate corresponding to a tempo desired by the user, wherein said sensor records the taps and time interval between them to calculate tempo as beats per minute.

Yet another embodiment of the invention is a database of songs to be displayed by the method of the present invention, wherein the database comprises data for displaying musical notes of one or more songs to be displayed, wherein said data comprises separate portions of musical notes within each song to be displayed, and each portion of musical notes to be displayed is coded with the total number of beats contained in the musical notes of said portion.

Another embodiment of the invention is a computer-readable medium storing instructions executable by a processor to perform a method, the method comprising: selecting a song from the memory, displaying a first portion of musical notes from said song on the display screen, where the first portion is less than an entirety of the musical notes, detecting a tempo of a user's performance of the song on a musical device, calculating a time period for the user to complete, on the musical device, performance of said first displayed portion of musical notes, and automatically replacing, at an end of the time period, said first portion of musical notes on the display screen with a subsequent portion of musical notes from said song.

The method performed by the computer-readable medium of the present invention may comprise presenting a visual cue on the display screen that shows the user when each individual musical note within the first portion of musical notes should be completed according to the tempo of the user's performance. The visual cue may be a temporary change in a visual appearance of the musical note, on the display screen, that lasts for a period of time corresponding to a length of the musical note.

The method performed by the computer-readable medium may also display a portion of the musical notes in multiple ways, including as a single horizontal line or as at least two horizontal lines of musical notes from the song. This may include full pages of music from the song. In addition, lyrics associated with the song being displayed may optionally be displayed.

The method performed by the computer-readable medium may detect tempo may be conducted in multiple ways. For example, it may include receiving, via a microphone associated with the device, sounds from the user's performance, and measuring the tempo as beats per minute from the sounds received by the microphone, and wherein calculating the time period includes calculating a time period for the user to complete the first portion of musical notes by dividing a total number of beats in the first portion of musical notes by the user's beats per minute rate. In another manner, detecting the tempo may include detecting the tempo only once at a beginning of the song and using the tempo for calculating time periods for displaying subsequent portions of musical notes. Another embodiment includes detecting one or more tempos for different portions of the song. In another implementation, a first tempo and a second tempo are detected for a first subset of the song and a second subset of the song, respectively, wherein the time period is calculated for the user to complete, on the musical device, performance of said first subset of the song and said second subset of the song, and wherein at an end of the time period for the first subset of the song, wherein said first subset of the song on the display screen is automatically replaced with said second subset of the song, displayed at a rate corresponding to an end of the time period for the second subset of the song. Another implementation includes, optionally, detecting one or more additional tempos for one or more additional subsets of the song, which are displayed according to its calculated time period.

In another embodiment, the method performed by the computer-readable medium may comprise presenting, to the user, an option to order an additional song, receiving selection of the option, contacting a server device to obtain the additional song, and storing the additional song in the memory.

Another embodiment includes where the processor is one of a plurality of devices, and where displaying the first portion of musical notes includes displaying a first version, of the first portion of musical notes, on the display screen associated with the device, and concurrently displaying a second version, of the first portion of musical notes, on a display screen associated with another one of the plurality of devices, where the first version and the second version differ and correspond to a group of musical instruments. The plurality of connected devices may display the same or different versions of the song as the other devices.

The computer-readable medium may automatically replace musical notes in different ways. For example, in one embodiment, automatically replacing said first portion of musical notes includes continuously scrolling the at least two horizontal lines of musical notes, on the display screen, upward at a rate controlled by the calculated time period. In another embodiment, the automatically replacing said first portion of musical notes includes concurrently removing an entirety of the at least two horizontal lines of musical notes from the display screen and presenting subsequent set of lines of musical notes from the song. In yet another embodiment, automatically replacing said first portion of musical notes includes concurrently removing a subset of the at least first portion of musical notes from the display screen and presenting subsequent lines of musical notes from the song.

DETAILED DESCRIPTION OF THE INVENTION

Figure 1:
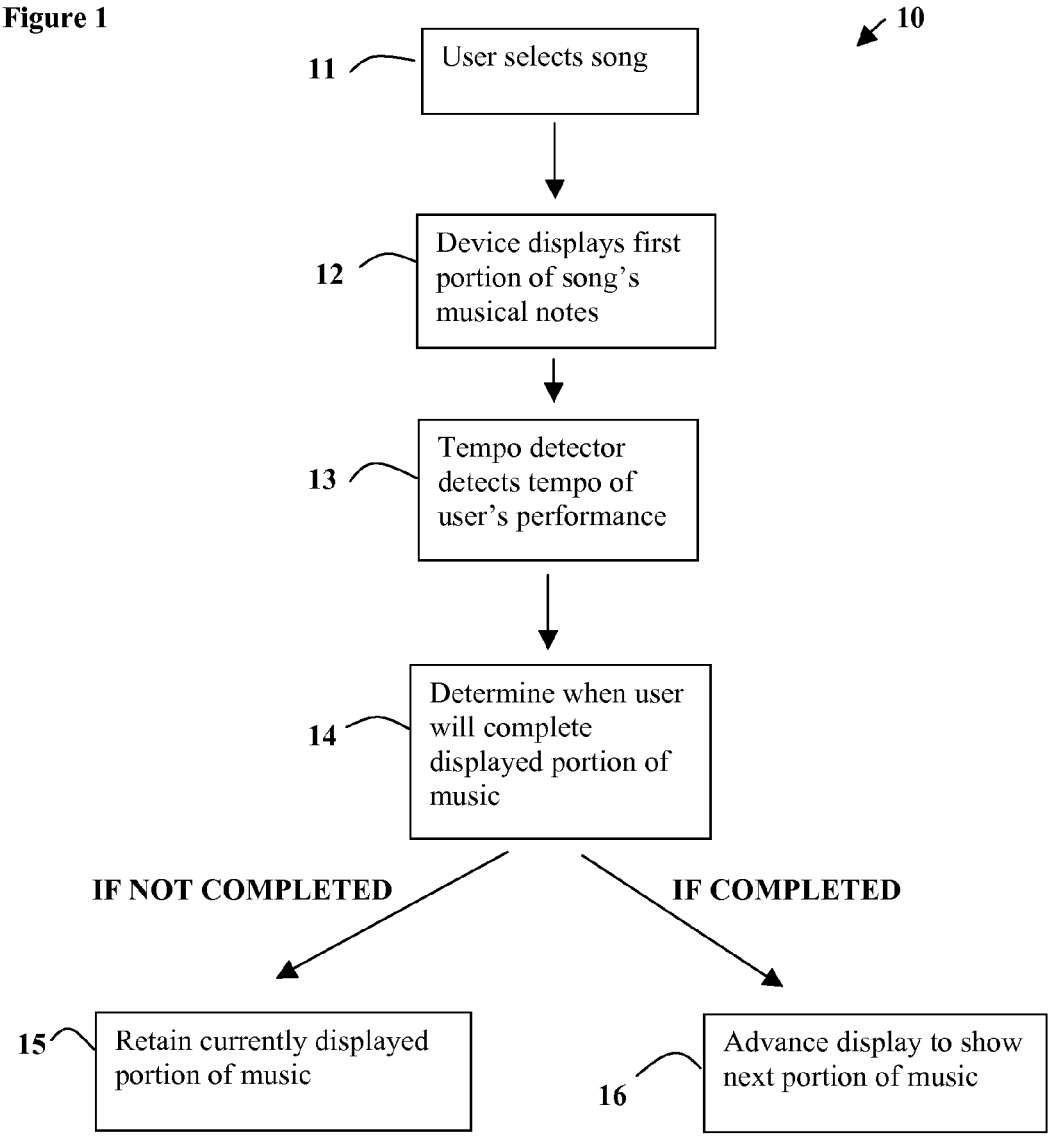
FIG. 1 is a flowchart illustrating one embodiment of an automatic music scrolling method in accordance with the present invention using a tempo detector which automatically adjusts display time according to a user's actual tempo by detecting the user's tempo.

Unless otherwise specified, "a" or "an" means "one or more".

Typical sheet music includes lines of music arranged horizontally on a page. Within each line, there are smaller units known as measures. Within each measure, there are individual musical notes, depicted by a variety of different symbols that also indicate the number of beats (duration) assigned to the note. For example, in music played at a 4/4 time signature, a whole note lasts 4 beats, a half note has 2 beats, etc. In this manner, the number of beats contained in a single line of sheet music can be determined.

Tempo, which is commonly expressed as beats per minute, controls the rate at which the musical notes in a line of music are played. With a given tempo, one may determine the amount of time in which the line of sheet music should be played. For example, if a single line of sheet music with a 4/4 time signature contains 8 whole notes, 2 half notes and 14 quarter notes, then the total number of beats in that line of sheet music would be $(8\times4)+(2\times2)+(14\times1)$, or a total of 50 beats. If the user's tempo for performing that song is 100 beats per minute, then the line of music should be completed in 50/100 minute, or half a minute (30 seconds). Thus, for any line of sheet music, given a user's tempo, one may calculate the amount of time which should be required for a user to finish performing that line and hence, how long that line of music should be displayed on a display screen in relation to that user's tempo.

In one embodiment, the present invention is directed to a method of displaying music on a display screen associated with a device that includes a memory and a processor, the method, performed by the device, comprising: selecting a song from the memory, displaying a first portion of musical notes from said song on the display screen, where the first portion is less than an entirety of the musical notes, detecting a tempo of a user's performance of the song on a musical device, calculating a time period for the user to complete, on the musical device, performance of said first displayed portion of musical notes, and automatically replacing, at an end of the time period, said first portion of musical notes on the display screen with a subsequent portion of musical notes from said song.

Optionally, the processor further provides a visual cue on the display screen that shows the user a desired tempo or indicates when each individual musical note within the portion of displayed musical notes should be completed according to a pre-set tempo. For example, the visual cue may be a temporary change in color of the musical note that lasts for a period of time corresponding to length of the musical note in relation to the tempo, e.g., at a tempo of 100 beats per minute, a whole note lasting 4 beats would be shown in a different color on the display screen for 4/100 of a minute. Another example of a suitable visual cue is a blinking light on the display screen that blinks at intervals matching the beats per minute of the pre-set tempo.

There are a number of different configurations which are suitable for displaying each portion of musical notes on the display screen, depending on the size of the display screen. For example, one or more horizontal lines of music can be displayed that correspond roughly to a 8.5×10 inch paper sheet of music, if the display screen is sufficiently large. Each sheet on the display screen can be replaced with the next sheet to be displayed after the prior display period ends. Alternatively, the displayed portion of musical notes may be displayed along a single horizontal line, which is continuously scrolled from right to left at a rate controlled by the user's tempo. In another embodiment, the displayed portion may be continuously replaced with a subsequent portion of the musical notes in the song. In yet another implementation, one portion of the musical notes in one section of the song may be shown as a page and that portion is automatically replaced with the next section of the song based upon the detected tempo. In this manner, the digital page of music, made of consecutive lines of musical notes of the song, can be automatically replaced with the next set of consecutive lines of musical notes of the song. In one embodiment, the displayed portion of musical notes is at least two horizontal lines of musical notes from the song. In another embodiment, the displayed portion of musical notes is two, three, four, five, six or seven horizontal lines of music.

There are a number of suitable tempo detectors available for use in the present invention. In one embodiment, the tempo detector comprises a microphone that receives sounds from the user's performance and measures the tempo as beats per minute from the sounds received by the microphone, wherein the processor calculates a time period for the user to complete the displayed portion of musical notes by dividing the total number of beats in the displayed portion of musical notes into the user's beats per minute rate. For example, if the detected tempo is 100 beats per minute, and the displayed portion of musical notes contains 50 beats, then the processor would calculate a display time period of 50/100 minutes, or 30 seconds. An example of a known tempo detection algorithm is found in Beat Monitor at http://www.sharewareconnection.com/beat-monitor.htm.

Another suitable tempo detector comprises a pressure sensor that determines a user's tempo when the user taps the sensor two or more times at a rate corresponding to a tempo desired by the user which will be maintained over the duration of the piece being played, wherein said sensor records the taps and time interval between them to calculate tempo as beats per minute. For example, see Tap That 1.0.2 at http://pda.wareseeker.com/Multimedia/tap-that-1.0.2.zip/150596f669. In one embodiment, tempo is detected only once at a beginning of the selected song when the user taps the sensor to set a desired tempo, and the same tempo is applied to calculate time periods for displaying each portion of musical notes. It is appreciated that the tempo may change within a song. Therefore, it is within the scope of this invention to allow the user to input more than one tempo for more than one subset of the song. For example, a song may be written in 4/4 time during one subset of the song and then be written in 3/8 time in another subset of the song and 3/4 time in another subset of the song. In this manner, the tempo detector may allow the user to input the desired tempo for each subset of the song requiring a different tempo.

In an embodiment, the display screen, memory, tempo detector, and processor are housed in a single device. Optionally, the single device further includes a projector, so that the portion of musical notes to be displayed may optionally be projected onto another surface as a larger sized image. Preferably, the single device is a tablet device adapted to fit on a music stand. In another preferred embodiment, the single device is a personal digital assistant or a cell phone, such as an iPhone®. Even more preferably, the personal digital assistant or cell phone further comprises a micro-projector, so that the portion of musical notes to be displayed may optionally be projected onto another surface as a larger sized image. In the case of a cell phone, optionally a user may order additional songs to be stored in the memory through an interface on the cell phone for communicating with a database of songs as described below. In another embodiment, the device is a table device, such as an iPad®.

Optionally, song lyrics are also displayed with the musical notes in each displayed portion of the song.

In yet another embodiment, the method may include a plurality of the tablet devices, such as an iPad®. Where a plurality of tablet devices are utilized, each device may display corresponding portions of the musical notes of the song for a group of musicians, each playing either the same or different instruments. In this embodiment, one tablet-shaped device may serve as a master with the tempo detector that wirelessly controls the displayed portion of musical notes for each different instrument on each of the other tablet-shaped devices. In another embodiment, the other tablet-shaped devices controlled by the master may not have tempo detectors. Optionally, the master tablet-shaped device uses bluetooth communication to control the other tablet-shaped devices.

With respect to the portion of musical notes displayed on the display screen or projected by a projector, optionally the displayed portion may include at least two horizontal lines of musical notes on the display screen, which are continuously scrolled upward at a rate controlled by the calculated time period based on the user's tempo. Alternatively, the at least two horizontal lines of musical notes on the display screen are replaced at the same time after the calculated display time period with a subsequent portion of musical notes from the song. It is noted that the timing of automatic replacement may be adjusted to accommodate the user's desires. For example, a user may desire to have the music automatically replaced earlier than the calculated end time for the displayed portion. In this manner, the user may have the displayed portion replaced with the subsequent portion of music 1, 2, 3, 4, 5, or 6 beats earlier than the calculated end time for that portion of the displayed music. In still another approach, the at least two horizontal lines of musical notes on the display screen are replaced one line at a time after the calculated display time period with a subsequent line of musical notes from the song, with each line being moved upward one position as the replacement occurs.

In an embodiment of the present invention, a database of songs to be displayed according to the foregoing method is created in an automated manner. For example, sheet music for each song can be converted to digitized form after being scanned with optical character recognition software (OCR) for musical note recognition, or else a MIDI file of the song can be input into the database which already contains the musical notes in digitized form. A processor then can separate and index each line of musical notes within the song as a separate portion to be displayed on the display screen in the correct sequence. How the processor divides the portions of musical notes to be displayed will depend upon the selected display configuration (e.g., how many lines to displayed at one time and the length of each line) and the overall size of the display screen.

In an alternative embodiment, the database of songs can be prepared manually, wherein each portion of musical notes to be displayed is indexed with information about the total number of beats contained in that displayed portion of musical notes. In this embodiment, optionally the database can be created by a user with a tablet device or personal digital assistant (PDA) or cell phone that has a camera function and an application for indexing and storing images of sheet music captured by the user. For example, a user can photograph sheet music or portions of sheet music using the camera to create a sequence of images stored on the PDA or cell phone. At the beginning of a capture session, the user is prompted to assign a name for the song. After each photo of sheet music is taken, the application tags that photo with the song name and then prompts the user to enter the number of beats contained in the captured image. The application then tags each captured segment with the number of beats entered by the user. The application then stores all of the tagged segments with each segment's number of beats under the song name in the database on the PDA or cell phone. This allows the user to create a virtual library of sheet music on their PDA or cell phone, which can be retrieved by the user on demand and displayed and scrolled in accordance with the embodiments set forth herein.

Accordingly, another embodiment of the invention is a database of songs to be displayed by the method of the present invention, wherein the database comprises data permitting one or more songs to be displayed, wherein each portion of musical notes to be displayed is coded with the total number of beats contained in the musical notes of said portion.

This database of pre-formatted songs for display according to the invention may be accessed by a user, for example, using any suitable device to purchase and download one or more songs from the database (e.g., through an existing interface provided by the cell phone's carrier that connects a user's cell phone with the database), which may also optionally be purchased together with an application that executes the music display method of the invention on the user's cell phone.

FIG. 1 is a flowchart illustrating one exemplary embodiment of a method 10 for providing automatic scrolling of a previously selected music score. The method begins at step 11, where a user selects a song to be displayed. Based on the selected song, a first portion of musical notes from the song is displayed on a display screen for the user to perform in step 12. In step 13, a tempo detector detects the tempo of the user as he or she is performing the first portion of music displayed on the display screen. After tempo is detected, a processor in step 14 can determine the amount of time it will take for the user to complete the displayed portion of music based on the user's actual tempo. For example, one tempo detector algorithm can calculate beats per minute of a user's performance by receiving sounds generated by the user through a microphone. If the processor determines that the first portion of displayed music has not been completed based on the user's tempo, then in step 15 it retains the display of the first portion of music until the end of the time period is reached. If the processor determines that the first portion of displayed music has been completed based on the user's tempo, then in step 16 it advances the display to show the next portion of musical notes from the song. In such a manner, the steps are repeated until the end of the song is reached. It is noted that different portions of the displayed musical notes may have a different tempo than others. However, the processor in step 14 can determine the amount of time it will take for the user to complete the displayed of music based on the user's actual tempo. This embodiment may be adapted for a continuous scroll method, where the lines of musical notes slowly and continuously advance (either from bottom to top or horizontally across a display), or it may be adapted for displaying one portion at a time (page by page) where the entire displayed portion is replaced at each interval with a completely new portion of musical notes. In one embodiment, the user may advance the subsequent displayed portion of musical notes within a prescribed time, such as 1, 2, 3, 4, 5, 6, 7, or 8 beats in advance of the subsequent portion of musical notes or a prescribed number of measures of the song in advance, such a 1, 2, 3, or 4 measures in advance.

Figure 2:
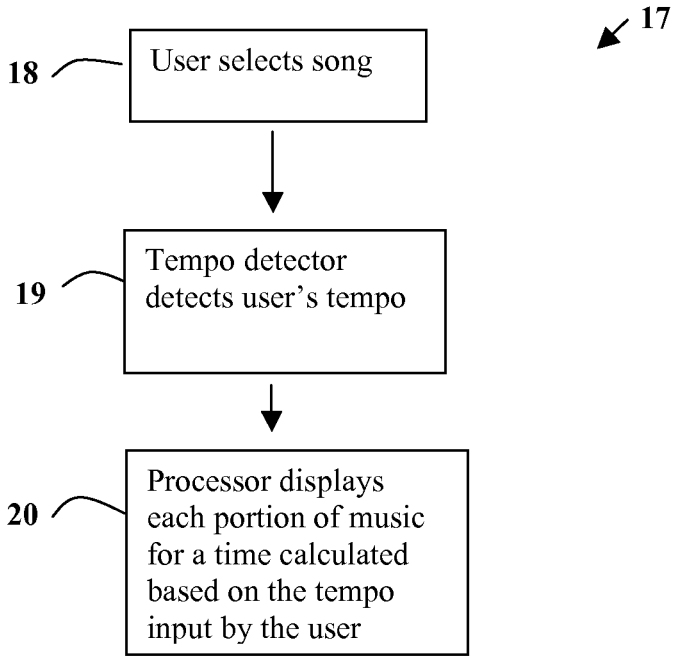
FIG. 2 is a flowchart illustrating another embodiment for an automatic music scrolling method of the present invention in which a user inputs the tempo at the beginning of a session, and the tempo input by the user controls the display time for each portion of music during that session.

FIG. 2 is a flowchart illustrating another embodiment of a method 17 where tempo is detected only once at the beginning of a session. In step 18, the user selects a song to be performed. In step 19, a tempo detector detects the user's tempo to be used for the session. For example, using a device with touch screen detection, a user taps the screen several times to set the tempo he or she wishes to use, allowing the tempo detector to detect the user's tempo in beats per minute. In step 20, a processor displays a portion of music for a time corresponding to the time needed by the user to complete the number of beats in the displayed portion of music based on the tempo detected by the tempo detector. This method may be used to detect tempo only once at the beginning of a session, and the user continues to perform throughout that session by following the tempo. Preferably, in this method, a display light flashes the tempo on the music display during the session to remind the user of the tempo set at the beginning.

Figure 3:
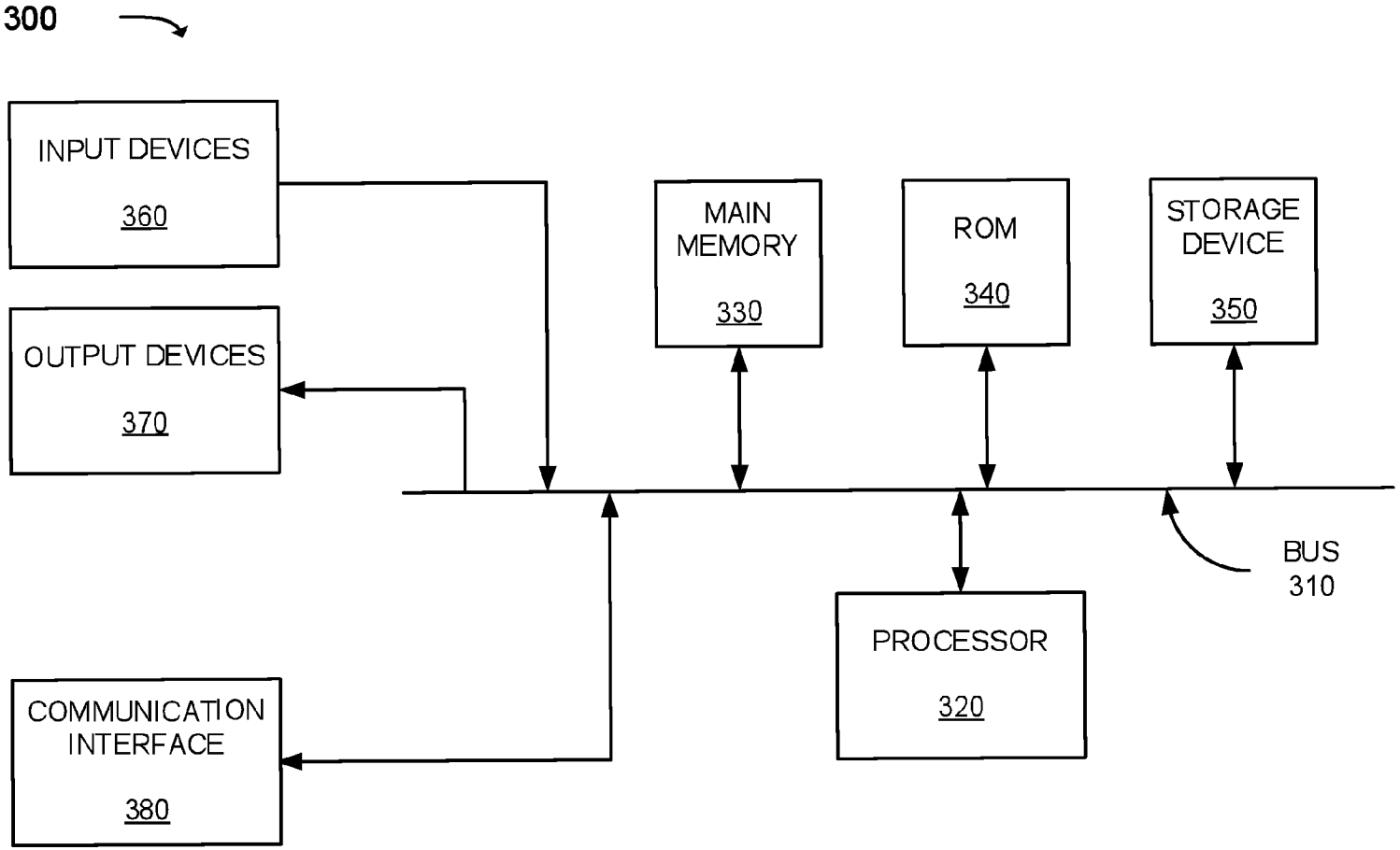
FIG. 3 is a diagram of an exemplary system in which systems and methods consistent with the principles of the invention may be implemented.

FIG. 3 is a diagram of example components of a device 300 that may be used to perform one or more of the processes described herein. Device 300 may take various forms, such as a personal computer, a mobile device, a personal digital assistant (PDA), a portable computer (e.g., a tablet computer, a laptop computer, etc.).

As shown in FIG. 3, device 300 may include a bus 310, a processor 320, a main memory 330, a read only memory (ROM) 340, a storage device 350, one or more input devices 360, one or more output devices 370, and a communication interface 380. In another implementation, device 300 may include additional components, fewer components, different components, or differently arranged components.

Bus 310 may include one or more conductors that permit communication among the components of device 300. Processor 320 may include a processor, a microprocessor, coprocessors, or processing logic that interprets and executes instructions. Main memory 330 may include a random access memory (RAM) or another type of dynamic storage device that stores information and instructions for execution by processor 320. ROM 340 may include a ROM device or another type of static storage device that stores static information and instructions for use by processor 320. Storage device 350 may include a magnetic and/or optical recording medium and its corresponding drive, or a form of removable memory, such as flash memory.

Input devices 360 may include mechanisms that permit an operator to input information into device 300, such as a keyboard, a mouse, a pen, voice recognition mechanisms, a touch screen of a display, etc. Output devices 370 may include mechanisms that output information to the operator, including a display, a speaker, etc. Communication interface 380 may include any transceiver-like mechanism that enables device 300 to communicate with other devices and/or networks. For example, communication interface 380 may include a wireless interface for communicating with a device of a wireless network, a wired interface for communicating with another device, or a combination of a wireless interface and a wired interface.

As described herein, device 300 may perform certain operations relating to displaying scrolling musical notes. Device 300 may perform these operations in response to processor 320 executing software instructions contained in a computer-readable medium, such as memory 330. A computer-readable medium may be defined as a non-transitory memory device.

The software instructions may be read into memory 330 from another computer-readable medium, such as data storage device 350, or from another device via communication interface 380. The software instructions contained in memory 330 may cause processor 320 to perform processes that will be described later. Alternatively, hardwired circuitry may be used in place of or in combination with software instructions to implement processes described herein.

All references cited herein are incorporated in their entirety to the same extent as if individually incorporated by reference.

We claim:

1. A method of displaying music on a display screen associated with a device that includes a memory and a processor, the method, performed by the device, comprising:

selecting a song from the memory, displaying a first portion of musical notes from said song on the display screen, where the first portion is less than an entirety of the musical notes, detecting a tempo of a user's performance of the song on a musical device, calculating a time period for the user to complete, on the musical device, performance of said first displayed portion of musical notes, and automatically replacing, at an end of the time period, said first portion of musical notes on the display screen with a subsequent portion of musical notes from said song.

2. The method of claim 1, further comprising:

presenting a visual cue on the display screen that shows the user when each individual musical note within the first portion of musical notes should be completed according to the tempo of the user's performance.

3. The method of claim 2, wherein the visual cue is a temporary change in a visual appearance of the musical note, on the display screen, that lasts for a period of time corresponding to a length of the musical note.

4. The method of claim 2, wherein the first portion of musical notes is displayed along a single horizontal line, which is continuously scrolled from right to left at a rate controlled by the tempo of the user's performance.

5. The method of claim 2, wherein the first portion of musical notes is at least two horizontal lines of musical notes from the song.

6. The method of claim 1, wherein the device is one of a plurality of devices, and where displaying the first portion of musical notes includes:

displaying a first version, of the first portion of musical notes, on the display screen associated with the device, and concurrently displaying a second version, of the first portion of musical notes, on a display screen associated with another one of the plurality of devices, where the first version and the second version differ and correspond to a group of musical instruments.

7. The method of claim 1, wherein the device is one of a plurality of connected devices, and where the musical notes on the display screen of the device may be the same or different from the musical notes on the display screen of the other connected devices.

8. The method of claim 5, wherein automatically replacing said first portion of musical notes includes continuously scrolling the at least two horizontal lines of musical notes, on the display screen, upward at a rate controlled by the calculated time period.

9. The method of claim 5, wherein automatically replacing said first portion of musical notes includes concurrently removing an entirety of the at least two horizontal lines of musical notes from the display screen and presenting subsequent set of lines of musical notes from the song.

10. The method of claim 5, wherein automatically replacing said first portion of musical notes includes concurrently removing a subset of the at least first portion of musical notes from the display screen and presenting subsequent lines of musical notes from the song.

11. The method of claim 1, wherein detecting the tempo includes detecting the tempo either only once at a beginning of the song or more than one time throughout the song and using the tempo for calculating time periods for displaying subsequent portions of musical notes.

12. A device, comprising:

a memory to store a plurality of songs, an input device to receive selection of one of the plurality of songs, a display screen, and a processor to:

present a first portion of musical notes from said song on a display screen associated with the device, where the first portion is less than an entirety of the musical notes, detect a tempo of a user's performance of the song on a musical device, calculate a time period for the user to complete, on the musical device, performance of said first displayed portion of musical notes, and automatically replace, at an end of the time period, said first portion of musical notes on the display screen with a subsequent portion of musical notes from said song.

13. The device of claim 12, wherein the display screen, input device, memory, and processor are housed in a single device.

14. The device of claim 13, wherein the single device is a personal digital assistant or a tablet device.

15. The device of claim 12, wherein the device is one of a plurality of connected devices, wherein one device of the plurality of connected devices is a master with the tempo detector that wirelessly controls the displayed portion of musical notes for each different instrument on each of the other connected devices.

16. The device of claim 13, wherein the device includes a micro-projector, and where displaying the first portion of musical notes includes projecting the first portion of musical notes onto a surface for viewing by the user.

17. The device of claim 13, wherein the tempo detector comprises a pressure sensor that determines a user's tempo when the user taps the sensor two or more times at a rate corresponding to a tempo desired by the user, wherein said sensor records the taps and time interval between them to calculate tempo as beats per minute.

18. A computer-readable medium storing instructions executable by a processor to perform a method, the method comprising:

selecting a song from the memory, displaying a first portion of musical notes from said song on the display screen, where the first portion is less than an entirety of the musical notes, detecting a tempo of a user's performance of the song on a musical device, calculating a time period for the user to complete, on the musical device, performance of said first displayed portion of musical notes, and automatically replacing, at an end of the time period, said first portion of musical notes on the display screen with a subsequent portion of musical notes from said song.

19. The computer-readable medium of claim 18, wherein the method further comprises:

presenting a visual cue on the display screen that shows the user when each individual musical note within the first portion of musical notes should be completed according to the tempo of the user's performance.

20. The computer-readable medium of claim 19, wherein the visual cue is a temporary change in a visual appearance of the musical note, on the display screen, that lasts for a period of time corresponding to a length of the musical note.

21. The computer-readable medium of claim 18, wherein the first portion of musical notes is displayed along a single horizontal line, which is continuously scrolled from right to left at a rate controlled by the tempo of the user's performance.

22. The computer-readable medium of claim 18, wherein the first portion of musical notes is at least two horizontal lines of musical notes from the song.

23. The computer-readable medium of claim 18, wherein detecting the tempo of the user's performance includes:

receiving, via a microphone associated with the device, sounds from the user's performance, and measuring the tempo as beats per minute from the sounds received by the microphone, and wherein calculating the time period includes calculating a time period for the user to complete the first portion of musical notes by dividing a total number of beats in the first portion of musical notes by the user's beats per minute rate.

24. The computer-readable medium of claim 18, wherein the processor is one of a plurality of devices, and where displaying the first portion of musical notes includes:

displaying a first version, of the first portion of musical notes, on the display screen associated with the device, and concurrently displaying a second version, of the first portion of musical notes, on a display screen associated with another one of the plurality of devices, where the first version and the second version differ and correspond to a group of musical instruments.

25. The computer-readable medium of claim 18, wherein the processor is one of a plurality of connected devices, and where the musical notes on the display screen of the device may be the same or different from the musical notes on the display screen of the other connected devices.

26. The computer-readable medium of claim 18, wherein automatically replacing said first portion of musical notes includes continuously scrolling the at least two horizontal lines of musical notes, on the display screen, upward at a rate controlled by the calculated time period.

27. The computer-readable medium of claim 18, wherein automatically replacing said first portion of musical notes includes concurrently removing an entirety of the at least two horizontal lines of musical notes from the display screen and presenting subsequent set of lines of musical notes from the song.

28. The computer-readable medium of claim 18, wherein automatically replacing said first portion of musical notes includes concurrently removing a subset of the at least first portion of musical notes from the display screen and presenting subsequent lines of musical notes from the song.

29. The computer-readable medium of claim 18, wherein detecting the tempo includes detecting the tempo only once at a beginning of the song and using the tempo for calculating time periods for displaying subsequent portions of musical notes.

30. The computer-readable medium of claim 18, wherein detecting the tempo includes detecting one or more tempos for different portions of the song.

31. The computer-readable medium of claim 18, wherein a first tempo and a second tempo are detected for a first subset of the song and a second subset of the song, respectively, wherein the time period is calculated for the user to complete, on the musical device, performance of said first subset of the song and said second subset of the song, and wherein at an end of the time period for the first subset of the song, said first subset of the song on the display screen is automatically replaced with said second subset of the song, displayed at a rate corresponding to an end of the time period for the second subset of the song.

* * * * *